US008844648B2

(12) United States Patent
Bittar et al.

(10) Patent No.: US 8,844,648 B2
(45) Date of Patent: Sep. 30, 2014

(54) SYSTEM AND METHOD FOR EM RANGING IN OIL-BASED MUD

(75) Inventors: Michael S. Bittar, Houston, TX (US); Jing Li, Pearland, TX (US); Shanjun Li, Katy, TX (US); Michael D. Finke, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 566 days.

(21) Appl. No.: 13/116,069

(22) Filed: May 26, 2011

(65) Prior Publication Data

US 2011/0308859 A1 Dec. 22, 2011

Related U.S. Application Data

(60) Provisional application No. 61/357,320, filed on Jun. 22, 2010.

(51) Int. Cl.
*E21B 47/02* (2006.01)
*E21B 47/022* (2012.01)

(52) U.S. Cl.
CPC ..... *E21B 47/022* (2013.01)
USPC ..... 175/45; 175/323

(58) Field of Classification Search
USPC ..... 175/45, 61, 62, 320, 323; 73/152.03
See application file for complete search history.

(56) References Cited

U.S. PATENT DOCUMENTS 3,614,600 A 10/1971 Ronka et al.
4,472,684 A 9/1984 Schuster
4,502,010 A 2/1985 Kuckes
4,605,268 A 8/1986 Meador
4,700,142 A 10/1987 Kuckes
4,845,434 A 7/1989 Kuckes et al.
4,933,640 A 6/1990 Kuckes (Continued)

FOREIGN PATENT DOCUMENTS

AU 2011202215 5/2013
AU 2011202518 5/2013

(Continued)

OTHER PUBLICATIONS

Bittar, Michael S., et al., "Invasion Profiling with a Multiple Depth of Investigation, Electromagnetic Wave Resistivity Sensor", SPE 28425, 69th Annual Technical Conference and Exhibition of the SPE, New Orleans, LA, (Sep. 25, 1994), pp. 1-12, plus 11 pgs of Figures.

(Continued)

*Primary Examiner* — Kenneth L Thompson
(74) *Attorney, Agent, or Firm* — Krueger Iselin LLP; Alan Bryson

(57) ABSTRACT

Nearby conductors such as pipes, well casing, etc., are detectable from within a borehole filled with an oil-based fluid. At least some method embodiments provide a current flow between axially-spaced conductive bridges on a drillstring. The current flow disperses into the surrounding formation and causes a secondary current flow in the nearby conductor. The magnetic field from the secondary current flow can be detected using one or more azimuthally-sensitive antennas. Direction and distance estimates are obtainable from the azimuthally-sensitive measurements, and can be used as the basis for steering the drillstring relative to the distant conductor. Possible techniques for providing current flow in the drillstring include imposing a voltage across an insulated gap or using a toroid around the drillstring to induce the current flow.

22 Claims, 6 Drawing Sheets

(56) References Cited

U.S. PATENT DOCUMENTS

| | | | | |
|---|---|---|---|---|
| 5,138,313 | A | 8/1992 | Barrington | |
| 5,200,705 | A * | 4/1993 | Clark et al. | 324/338 |
| 5,339,036 | A * | 8/1994 | Clark et al. | 324/338 |
| 5,389,881 | A | 2/1995 | Bittar et al. | |
| 5,541,517 | A | 7/1996 | Hartmann | |
| 5,720,355 | A | 2/1998 | Lamine et al. | |
| 6,098,727 | A | 8/2000 | Ringgenberg et al. | |
| 6,163,155 | A | 12/2000 | Bittar | |
| 6,191,586 | B1 | 2/2001 | Bittar | |
| 6,218,842 | B1 | 4/2001 | Bittar | |
| 6,257,334 | B1 | 7/2001 | Cyr | |
| 6,353,321 | B1 | 3/2002 | Bittar | |
| 6,359,438 | B1 | 3/2002 | Bittar | |
| 6,405,136 | B1 * | 6/2002 | Li et al. | 702/10 |
| 6,476,609 | B1 | 11/2002 | Bittar | |
| 6,538,447 | B2 | 3/2003 | Bittar | |
| 6,646,441 | B2 | 11/2003 | Thompson et al. | |
| 6,810,331 | B2 | 10/2004 | Bittar et al. | |
| 6,885,943 | B2 | 4/2005 | Bittar et al. | |
| 6,911,824 | B2 | 6/2005 | Bittar | |
| 6,944,546 | B2 | 9/2005 | Xiao et al. | |
| 7,019,528 | B2 | 3/2006 | Bittar | |
| 7,038,455 | B2 | 5/2006 | Beste et al. | |
| 7,046,010 | B2 | 5/2006 | Hu et al. | |
| 7,098,664 | B2 | 8/2006 | Bittar et al. | |
| 7,098,858 | B2 | 8/2006 | Bittar et al. | |
| 7,133,779 | B2 | 11/2006 | Tilke et al. | |
| 7,138,803 | B2 | 11/2006 | Bittar | |
| 7,227,363 | B2 | 6/2007 | Gianzero et al. | |
| 7,265,552 | B2 | 9/2007 | Bittar | |
| 7,268,019 | B2 | 9/2007 | Golla et al. | |
| 7,301,223 | B2 | 11/2007 | Rodney et al. | |
| 7,345,487 | B2 | 3/2008 | Bittar et al. | |
| 7,427,862 | B2 | 9/2008 | Dashevsky et al. | |
| 7,427,863 | B2 | 9/2008 | Bittar | |
| 7,477,162 | B2 | 1/2009 | Clark | |
| 7,557,579 | B2 | 7/2009 | Bittar | |
| 7,557,580 | B2 | 7/2009 | Bittar | |
| 7,659,722 | B2 | 2/2010 | Bittar | |
| 7,746,078 | B2 | 6/2010 | Bittar et al. | |
| 7,839,148 | B2 | 11/2010 | Vehra et al. | |
| 7,839,346 | B2 | 11/2010 | Bittar et al. | |
| 7,912,648 | B2 | 3/2011 | Tang et al. | |
| 7,948,238 | B2 | 5/2011 | Bittar | |
| 8,159,227 | B2 | 4/2012 | Wang | |
| 8,499,830 | B2 | 8/2013 | Alberty | |
| 2002/0005298 | A1 | 1/2002 | Estes et al. | |
| 2002/0105333 | A1 | 8/2002 | Amini | |
| 2005/0134280 | A1 | 6/2005 | Bittar et al. | |
| 2005/0140373 | A1 | 6/2005 | Li et al. | |
| 2006/0022887 | A1 | 2/2006 | Bittar | |
| 2006/0033502 | A1 | 2/2006 | Bittar | |
| 2006/0054354 | A1 | 3/2006 | Orban | |
| 2006/0244455 | A1 | 11/2006 | Bittar | |
| 2006/0255811 | A1 | 11/2006 | Bittar et al. | |
| 2007/0075874 | A1 | 4/2007 | Shah et al. | |
| 2007/0126426 | A1 | 6/2007 | Clark et al. | |
| 2007/0235225 | A1 | 10/2007 | Bittar | |
| 2008/0078580 | A1 | 4/2008 | Bittar | |
| 2008/0315884 | A1 | 12/2008 | Bittar et al. | |
| 2009/0015260 | A1 | 1/2009 | Bittar | |
| 2009/0164127 | A1 | 6/2009 | Clark | |
| 2009/0201026 | A1 | 8/2009 | McElhinney | |
| 2009/0224764 | A1 | 9/2009 | Bittar | |
| 2009/0230968 | A1 | 9/2009 | Bittar et al. | |
| 2009/0302851 | A1 | 12/2009 | Bittar et al. | |
| 2009/0309798 | A1 | 12/2009 | Bittar et al. | |
| 2011/0308794 | A1 | 12/2011 | Bittar et al. | |
| 2011/0309836 | A1 | 12/2011 | Bittar et al. | |
| 2012/0001637 | A1 | 1/2012 | Bittar et al. | |
| 2012/0283952 | A1 | 11/2012 | Tang et al. | |

FOREIGN PATENT DOCUMENTS

| | | |
|---|---|---|
| EP | 1315984 | 1/2011 |
| EP | 1155343 | 3/2011 |
| GB | 2441033 | 2/2008 |
| GB | 2481506 | 12/2011 |
| WO | WO-2007/149106 | 12/2007 |
| WO | WO-2008/008346 | 1/2008 |
| WO | WO-2008/008386 | 1/2008 |
| WO | WO-2008/021868 | 2/2008 |
| WO | WO-2008/036077 | 3/2008 |
| WO | WO-2009/014882 | 1/2009 |
| WO | WO-2009/091408 | 7/2009 |
| WO | WO-2009/131584 | 10/2009 |
| WO | WO-2010/006302 | 1/2010 |
| WO | WO-2010/065208 | 6/2010 |
| WO | WO-2010/075237 | 7/2010 |
| WO | WO-2011/049828 | 4/2011 |

OTHER PUBLICATIONS

Bittar, Michael S., "Resistivity Logging with Reduced Dip Artifacts", PCT Appl No. US2007/075455, filed Aug. 8, 2006.

Bittar, Michael S., et al., "Int'l Search Report and Written Opinion", dated Oct. 8, 2009, Appl No. PCT/US09/053354, "A High Frequency Dielectric Measurement Tool", filed Aug. 11, 2009, 11 pgs.

Bittar, Michael S., et al., "Antenna Coupling Component Measurement Tool Having a Rotating Antenna Configuration", PCT Appl No. US06/062149, filed Dec. 15, 2006.

Bittar, Michael S., et al., "A 3D Borehole Imager and a Dielectric Measurement Tool", PCT Appl No. US09/65537, filed Nov. 23, 2009.

Bittar, Michael S., et al., "Method and Apparatus with High Resolution Electrode Configuration for Imaging in Oil-Based Muds", U.S. Appl. No. 12/680,868, filed Mar. 30, 2010.

Bittar, Michael S., et al., "Systems and Methods for Displaying Logging Data", U.S. Appl. No. 12/295,158, filed Sep. 29, 2008.

Bittar, Michael S., et al., "Multimodal Geosteering Systems and Methods", U.S. Appl. No. 12/679,502, filed Mar. 23, 2010.

Bittar, Michael S., et al., "EM-Guided Drilling Relative to an Existing Borehole", U.S. Appl. No. 12/526,552, filed Aug. 10, 2009.

Bittar, Michael S., et al., "Robust Inversion Systems and Methods for Azimuthally Sensitive Resistivity Logging Tools", U.S. Appl. No. 12/299,760, filed Nov. 5, 2008.

Bittar, Michael S., et al., "Look-Ahead Boundary Detection and Distance Measurement", U.S. Appl. No. 12/067,582, filed Mar. 20, 2008.

Bittar, Michael S., et al., "Robust Inversion Systems and Methods for Azimuthally Sensitive Resistivity Logging Tools", U.S. Appl. No. 12/229,760, filed Nov. 5, 2008.

Bittar, Michael S., et al., "Systems and Methods Having Radially Offset Antennas for Electromagnetic Resistivity Logging", U.S. Appl. No. 12/300,876, filed Nov. 14, 2008.

Bittar, Michael S., et al., "Modular Geosteering Tool Assembly", U.S. Appl. No. 12/306,267, filed Dec. 23, 2008.

Bittar, Michael S., et al., "Method and Apparatus for Building a Tilted Antenna", U.S. Appl. No. 12/306,954, filed Dec. 30, 2008.

Bittar, Michael S., "Electromagnetic Wave Resistivity Tool Having a Tilted Antenna for Determining the Horizontal and Vertical Resistivities and Relative Dip Angle in Anisotropic Earth Formations", U.S. Appl. No. 09/238,832, filed Jan. 28, 1999.

Bittar, Michael S., "Electromagnetic Wave Resistivity Tool Having a Tilted Antenna for Determining the Horizontal and Vertical Resistivities and Relative Dip Angle in Anisotropic Earth Formations", U.S. Appl. No. 12/127,634, filed May 28, 2008.

Bittar, Michael S., "Electromagnetic Wave Resistivity Tool Having a Tilted Antenna for Determining the Horizontal and Vertical Resistivities and Relative Dip Angle in Anisotropic Earth Formations", U.S. Appl. No. 12/467,427, filed May 18, 2009.

Bittar, Michael S., "Electromagnetic Wave Resistivity Tool Having A Tilted Antenna for Geosteering Within A Desired Payzone", U.S. Appl. No. 09/615,501, filed Jul. 13, 2000.

(56) References Cited

OTHER PUBLICATIONS

Bittar, Michael S., "Electromagnetic Wave Resistivity Tool Having A Tilted Antenna for Geosteering Within A Desired Payzone", U.S. Appl. No. 10/255,048, filed Sep. 25, 2002.
Bittar, Michael S., "Electromagnetic Wave Resistivity Tool Having A Tilted Antenna for Geosteering Within A Desired Payzone", U.S. Appl. No. 10/616,429, filed Jul. 9, 2003.
Bittar, Michael S., "Electromagnetic Wave Resistivity Tool Having A Tilted Antenna for Geosteering Within A Desired Payzone", U.S. Appl. No. 11/198,068, filed Aug. 5, 2005.
Bittar, Michael S., "Electromagnetic Wave Resistivity Tool Having A Tilted Antenna for Geosteering Within A Desired Payzone", U.S. Appl. No. 11/457,709, filed Jul. 14, 2006.
Bittar, Michael S., "Electromagnetic Wave Resistivity Tool Having A Tilted Antenna for Geosteering Within A Desired Payzone", U.S. Appl. No. 11/745,822, filed May 8, 2007.
Bittar, Michael S., "Electromagnetic Wave Resistivity Tool Having A Tilted Antenna for Geosteering Within A Desired Payzone", U.S. Appl. No. 12/127,672, filed May 27, 2008.
Bittar, Michael S., "Electromagnetic Wave Resistivity Tool Having A Tilted Antenna for Geosteering Within A Desired Payzone", U.S. Appl. No. 12/467,434, filed May 18, 2009.
Bittar, Michael S., et al., "Method And Apparatus Having Antennas Configured To Measure Electrical Anisotropy", U.S. Appl. No. 12/088,061, filed Mar. 25, 2008.
Bittar, Michael S., et al., "Antenna Coupling Component Measurement Tool Having a Rotating Antenna Configuration", U.S. Appl. No. 12/294,557, filed Sep. 25, 2008.
Bittar, Michael S., et al., "Method and Apparatus for Detecting Deep Conductive Pipe", U.S. Appl. No. 13/106,032, filed May 12, 2011.
UK Combined Search and Examination Report, dated Jul. 18, 2011, Appl No. GB1109125.3, "Method and Apparatus for Detecting Deep Conductive Pipe", filed May 27, 2011, 7 pgs.
UK Combined Search and Examination Report, dated Sep. 16, 2011, Application No. 1109401.8, "*Real Time Determination of Casing Location and Distance with Tilted Antenna Measurement*", filed Jun. 3, 2011, 5 pgs.
AU First Examination Report, dated Jan. 30, 2012, Appl No. 2011202215, "Method and Apparatus for Detecting Deep Conductive Pipe", filed May 13, 2011, 2 pgs.
AU First Examiner'S Report, dated Mar. 7, 2012, Appl No. 2011202518, "Real Time Determination of Casing Location and Distance with Tilted Antenna Measurement", filed May 30, 2011, 2 pgs.
UK Examination Report, dated Jul. 19, 2012, Appl No. GB1109125.3, "Method and Apparatus for Detecting Deep Conductive Pipe", filed May 27, 2011, 2 pgs.
UK Examination Report, dated Aug. 8, 2012, Appl No. 1109401.8, "Real Time Determination of Casing Location and Distance with Tilted Antenna Measurement", filed Jun. 31, 2011, 2 pgs.
US Non-Final Office Action, dated Jun. 11, 2013, U.S. Appl. No. 13/106,032, "Method and Apparatus for Detecting Deep Conductive Pipe", filed May 12, 2011, 18 pgs.
US Non-Final Office Action, dated Oct. 23, 2013, U.S. Appl. No. 13/116,150, "Real Time Determination of Casing Location and Distance with Tilted Antenna Measurement", filed May 26, 2011, 20 pgs.
US Non-Final Office Action, dated Jan. 3, 2014, U.S. Appl. No. 13/106,032, "Method and Apparatus for Detecting Deep Conductive Pipe", filed May 12, 2011, 18 pgs.
US Final Office Action, dated May 8, 2014, U.S. Appl. No. 13/106,032, "Method and Apparatus for Detecting Deep Conductive Pipe", filed May 12, 2011, 15 pgs.
US Final Office Action, dated May 23, 2014, U.S. Appl. No. 13/106,032, "Method and Apparatus for Detecting Deep Conductive Pipe", filed May 12, 2011, 19 pgs.

* cited by examiner 16
24
210
206
L
L
202
204
26
208
212
14
222
220
232
234
230

16
24
210
206
302
202
204
304
26
208
308
14
212
306
Z
Y
X
φ

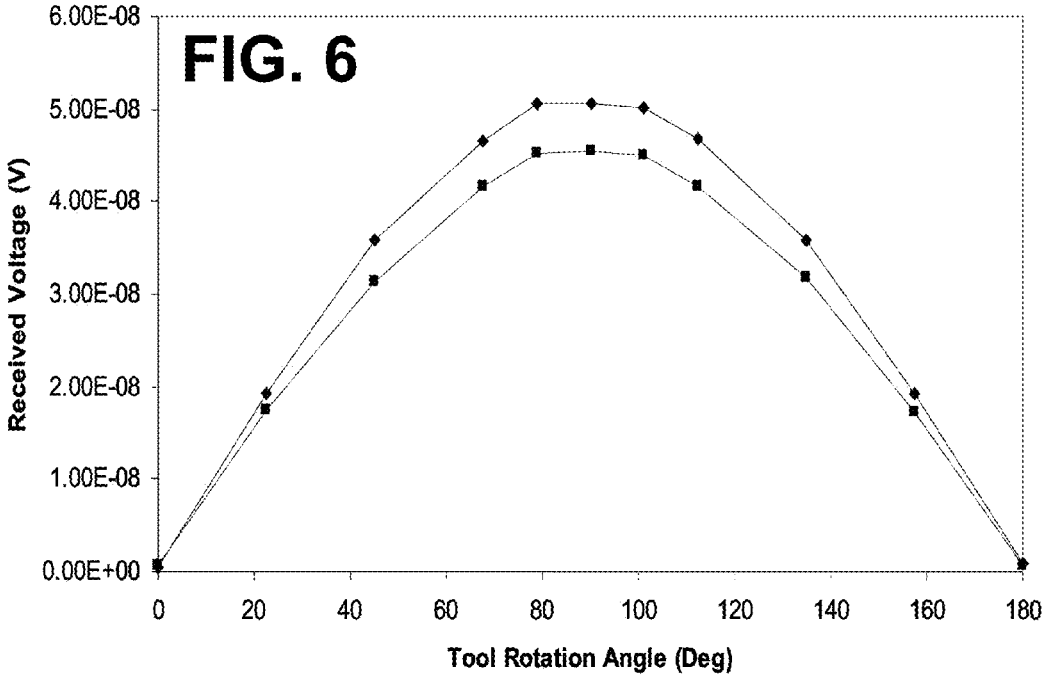
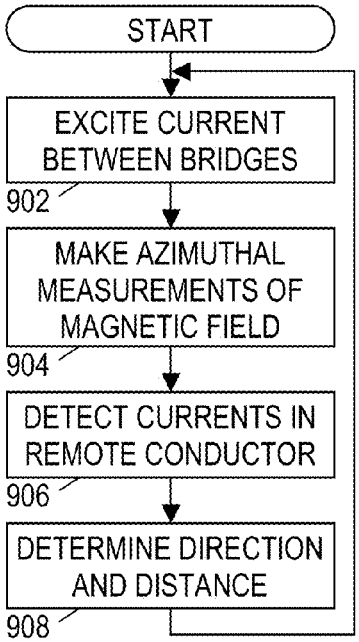
FIG. 9

SYSTEM AND METHOD FOR EM RANGING IN OIL-BASED MUD

CROSS-REFERENCE TO RELATED APPLICATIONS

This application claims priority to Provisional U.S. Application 61/357,320, titled "System and Method for EM Ranging in Oil-Based Mud Borehole" and filed Jun. 22, 2010 by M. Bittar, J. Li, S. Li, and M. Finke, which is hereby incorporated herein by reference.

BACKGROUND

The world depends on hydrocarbons to solve many of its energy needs. Consequently, oil field operators strive to produce and sell hydrocarbons as efficiently as possible. Much of the easily obtainable oil has already been produced, so new techniques are being developed to extract less accessible hydrocarbons. These techniques often involve drilling a borehole in close proximity to one or more existing wells. One such technique is steam-assisted gravity drainage ("SAGD") as described in U.S. Pat. No. 6,257,334, "Steam-Assisted Gravity Drainage Heavy Oil Recovery Process". SAGD uses a pair of vertically-spaced, horizontal wells less than 10 meters apart, and careful control of the spacing is important to the technique's effectiveness. Other examples of directed drilling near an existing well include intersection for blowout control, multiple wells drilled from an offshore platform, and closely spaced wells for geothermal energy recovery.

One way to direct a borehole in close proximity to an existing well is "active ranging" in which an electromagnetic source is located in the existing well and monitored via sensors on the drillstring. By contrast systems that locate both the source and the sensors on the drillstring are often termed "passive ranging". Passive ranging may be preferred to active ranging because it does not require that operations on the existing well be interrupted. Existing passive ranging techniques rely on magnetic "hot spots" in the casing of the existing well, which limits the use of these techniques to identify areas where there is a significant and abrupt change in the diameter of casing or where the casing has taken on an anomalous magnetic moment, either by pre-polarization of the casing before it is inserted into the wellbore, or as a random event. See, e.g., U.S. Pat. No. 5,541,517 "A method for drilling a borehole from one cased borehole to another cased borehole." In order to carry out such a polarization without interrupting production, it has been regarded as necessary to polarize the casing at some point in the construction of the well. This approach cannot be applied to wells that are already in commercial service without interrupting that service.

BRIEF DESCRIPTION OF THE DRAWINGS

A better understanding of the various disclosed embodiments can be obtained when the following detailed description is considered in conjunction with the accompanying drawings, in which:

FIG. 6 is an illustrative graph of receiver voltage as a function of orientation;

FIG. 9 is a flow diagram of an illustrative ranging method.

Figure 1:
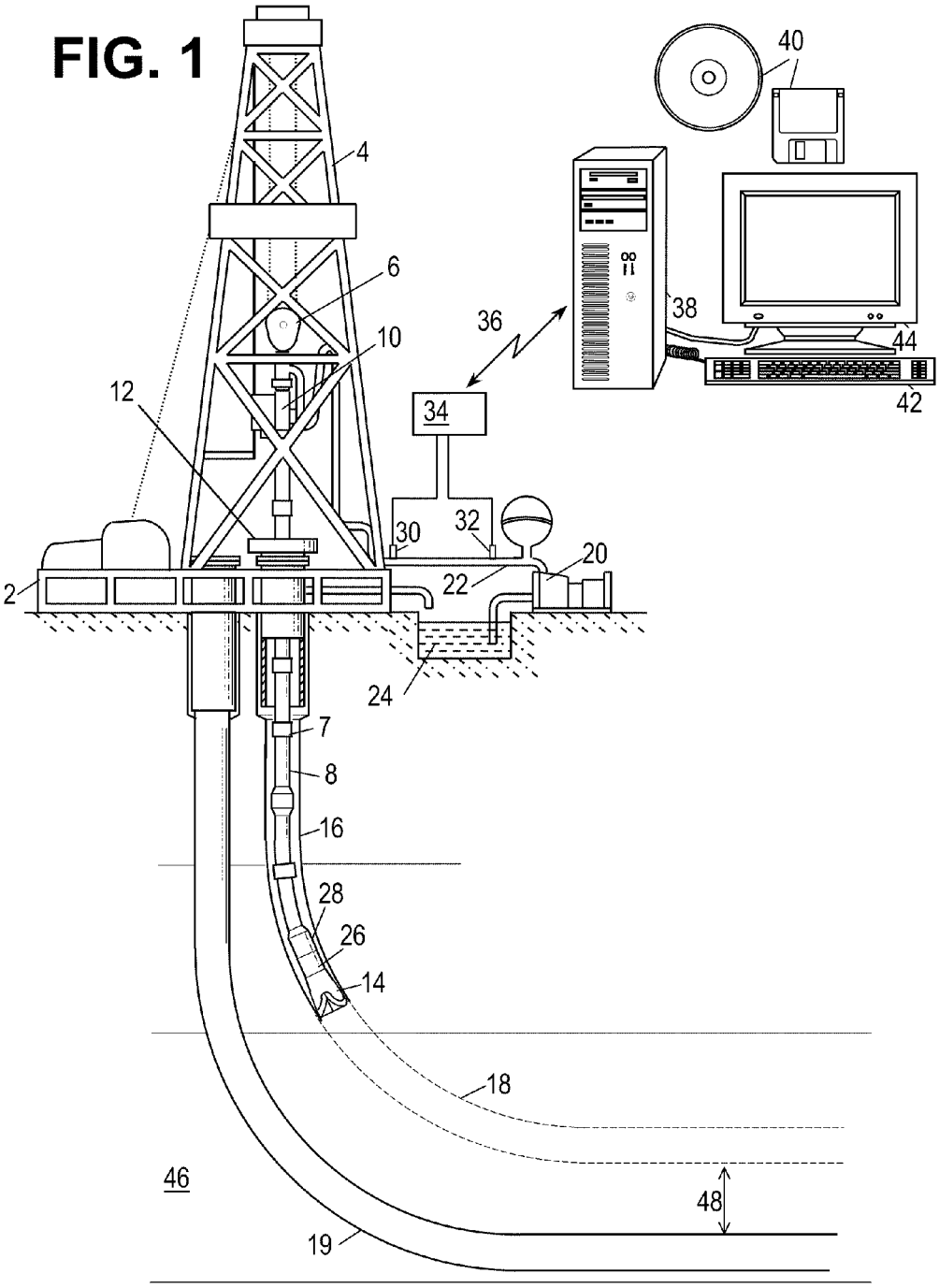
FIG. 1 shows an illustrative drilling environment in which electromagnetically-guided drilling may be employed.

While the invention is susceptible to various modifications and alternative forms, specific embodiments thereof are shown by way of example in the drawings and will herein be described in detail. It should be understood, however, that the drawings and detailed description are not intended to limit the disclosure to these particular embodiments, but on the contrary, the intention is to cover all modifications, equivalents and alternatives falling within the scope of the appended claims.

DETAILED DESCRIPTION

The issues identified in the background are at least partly addressed by disclosed methods and apparatus for detecting nearby conductors such as pipes, well casing, etc., from within a borehole filled with an oil-based fluid. At least some method embodiments provide a current flow between axially-spaced conductive bridges on a drillstring or other tubular in a borehole. The current flow disperses into the surrounding formation and causes a secondary current flow in the nearby conductor. The magnetic field from the secondary current flow can be detected using one or more azimuthally-sensitive antennas. Direction and distance estimates are obtainable from the azimuthally-sensitive measurements, and can be used as the basis for steering the drillstring relative to the distant conductor. Possible techniques for providing current flow in the drillstring include imposing a voltage across an insulated gap or using a toroid around the drillstring to induce the current flow.

A tool for detecting nearby conductors can take the form of a drill collar in a drillstring. The tool employs axially-spaced bridges to inject electric currents into the formation. An array of magnetic dipole antennas mounted on the collar operate to receive the magnetic fields generated by the currents in the nearby conductors. To cancel direct coupling from the source and increase sensitivity to conductive anomalies in the formation, the receiving coil antennas can be shaped symmetrically with respect to the Z-axis.

The disclosed systems and methods are best understood in a suitable usage context. Accordingly, FIG. 1 shows an illustrative geosteering environment. A drilling platform 2 supports a derrick 4 having a traveling block 6 for raising and lowering a drill string 8. A top drive 10 supports and rotates the drill string 8 as it is lowered through the wellhead 12. A drill bit 14 is driven by a downhole motor and/or rotation of the drill string 8. As bit 14 rotates, it creates a borehole 16 that passes through various formations.

A pump 20 circulates drilling fluid through a feed pipe 22 to top drive 10, downhole through the interior of drill string 8, through orifices in drill bit 14, back to the surface via the annulus around drill string 8, and into a retention pit 24. The drilling fluid transports cuttings from the borehole into the pit 24 and aids in maintaining the borehole integrity. In the present example, the drilling fluid is an oil-based mud (OBM), making it relatively non-conductive. Such fluids may be more suitable for drilling in shales and in deep-reach applications where greater lubricity and heat tolerance are desirable, but they often make electrical investigation of the surrounding formation more challenging.

The drill bit 14 is just one piece of a bottom-hole assembly that includes one or more drill collars (thick-walled steel pipe) to provide weight and rigidity to aid the drilling process. Some of these drill collars include logging instruments to gather measurements of various drilling parameters such as position, orientation, weight-on-bit, borehole diameter, etc. The tool orientation may be specified in terms of a tool face angle (a.k.a. rotational or azimuthal orientation), an inclination angle (the slope), and a compass direction, each of which can be derived from measurements by magnetometers, inclinometers, and/or accelerometers, though other sensor types such as gyroscopes may alternatively be used. In one specific embodiment, the tool includes a 3-axis fluxgate magnetometer and a 3-axis accelerometer. As is known in the art, the combination of those two sensor systems enables the measurement of the tool face angle, inclination angle, and compass direction. In some embodiments, the tool face and hole inclination angles are calculated from the accelerometer sensor output. The magnetometer sensor outputs are used to calculate the compass direction.

The bottom-hole assembly further includes a ranging tool 26 to induce a current in nearby conductors such as pipes, casing strings, and conductive formations and to collect measurements of the resulting field to determine distance and direction. Using these measurements in combination with the tool orientation measurements, the driller can, for example, steer the drill bit 14 along a desired path 18 relative to the existing well 19 in formation 46 using any one of various suitable directional drilling systems, including steering vanes, a "bent sub", and a rotary steerable system. For precision steering, the steering vanes may be the most desirable steering mechanism. The steering mechanism can be alternatively controlled downhole, with a downhole controller programmed to follow the existing borehole 19 at a predetermined distance 48 and position (e.g., directly above or below the existing borehole).

A telemetry sub 28 coupled to the downhole tools (including ranging tool 26) can transmit telemetry data to the surface via mud pulse telemetry. A transmitter in the telemetry sub 28 modulates a resistance to drilling fluid flow to generate pressure pulses that propagate along the fluid stream at the speed of sound to the surface. One or more pressure transducers 30, 32 convert the pressure signal into electrical signal(s) for a signal digitizer 34. Note that other forms of telemetry exist and may be used to communicate signals from downhole to the digitizer. Such telemetry may employ acoustic telemetry, electromagnetic telemetry, or telemetry via wired drillpipe.

The digitizer 34 supplies a digital form of the telemetry signals via a communications link 36 to a computer 38 or some other form of a data processing device. Computer 38 operates in accordance with software (which may be stored on information storage media 40) and user input via an input device 42 to process and decode the received signals. The resulting telemetry data may be further analyzed and processed by computer 38 to generate a display of useful information on a computer monitor 44 or some other form of a display device. For example, a driller could employ this system to obtain and monitor drilling parameters, formation properties, and the path of the borehole relative to the existing borehole 19 and any detected formation boundaries. A downlink channel can then be used to transmit steering commands from the surface to the bottom-hole assembly.

Figures 2A, 2B, 2C:
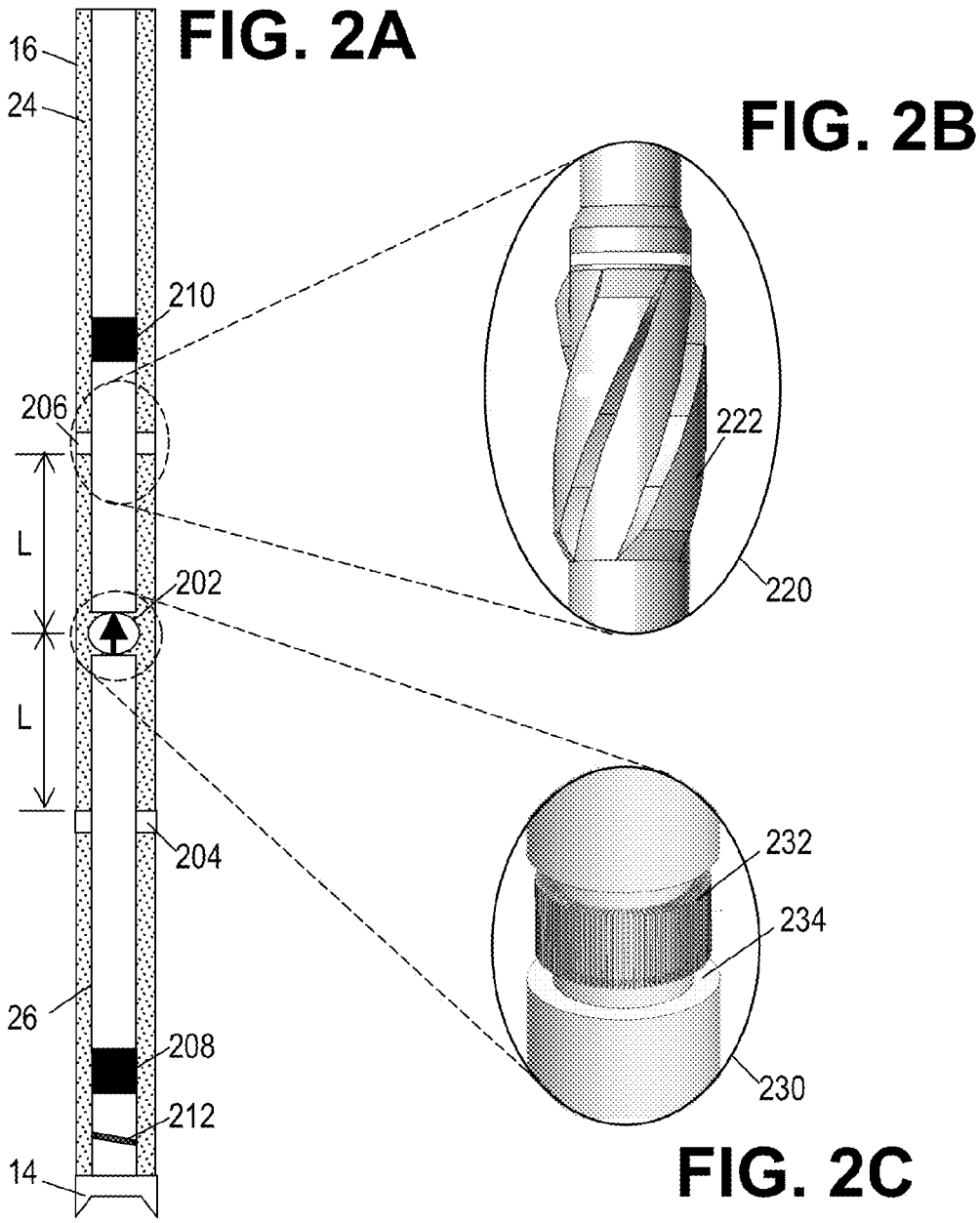
FIGS. 2A-2C shows an illustrative arrangement for passive ranging from a borehole filled with an oil-based fluid.

FIGS. 2A-2C shows an illustrative ranging tool 26 in more detail. It includes a current source 202. (The term "current source" is used in its most general sense. The current source may be, for example, a voltage source coupled across an insulated gap in the tool to induce a current flow between the bridges as described further below.) FIG. 2C shows a close-up view 230 of a toroid 232 set in a recess 234 around the tool for protection. A nonconductive filler material may be used to fill the remainder of the recess to seal and protect the toroid. As a changing current flows through the toroid's windings, it creates a changing magnetic field that is coaxial to the tool, which in turn induces a current flow parallel to the tool's axis.

The current source 202 is positioned between two conductive bridges 204, 206 that establish a low-impedance path between the current source and the formation. To reduce the impedance, the bridges either maintain contact with the formation or at least substantially reduce the thickness of the fluid layer between the tool and the formation. FIG. 2B shows a close-up view 220 of the bridge 206, which in this embodiment comprises a set of stabilizer blades 222 positioned at spaced intervals around the tool's circumference. The blades 222 may follow a helical path to provide complete circumferential coverage without impeding the flow of fluid through the annulus between the tool and the borehole wall. Alternatively, centralizer springs or other compliant conductors that maintain contact with the wall of the borehole may be used.

The bridges act as electrodes for injecting current into the formation. The distance between the bridge controls the dispersion of the currents into the formation, and hence is a factor in determining the range at which other conductors can be detected. The current source 202 is shown midway between the bridges, but this position is not critical.

The tool 26 may further include optional electrical insulators 208, 210 to confine the current flow from source 202 to the region between the bridges 204, 206. Without the electrical insulators, the net distance between the current injection points into the formation might be expected to vary based on, e.g., the intermittent contact between the borehole wall with other portions of the drillstring. A number of insulated gap manufacturing methods are known and disclosed, for example in U.S. Pat. No. 5,138,313 "Electrically insulative gap sub assembly for tubular goods", and U.S. Pat. No. 6,098,727 "Electrically insulating gap subassembly for downhole electromagnetic transmission". However, if experiments show that such variation is not a significant issue or that such variation can be prevented through the use of additional bridges and/or improved bridge design, electrical insulators 208, 210 can be eliminated.

Tool 26 further includes at least one magnetic field sensor 212, which in the illustrated example takes the form of a tilted coil antenna. The illustrated antenna/sensor may be part of a sensor array having multiple receiver stations with multicomponent sensing at each station. Such an arrangement may offer enhanced sensitivity to induced magnetic fields.

Figure 3:
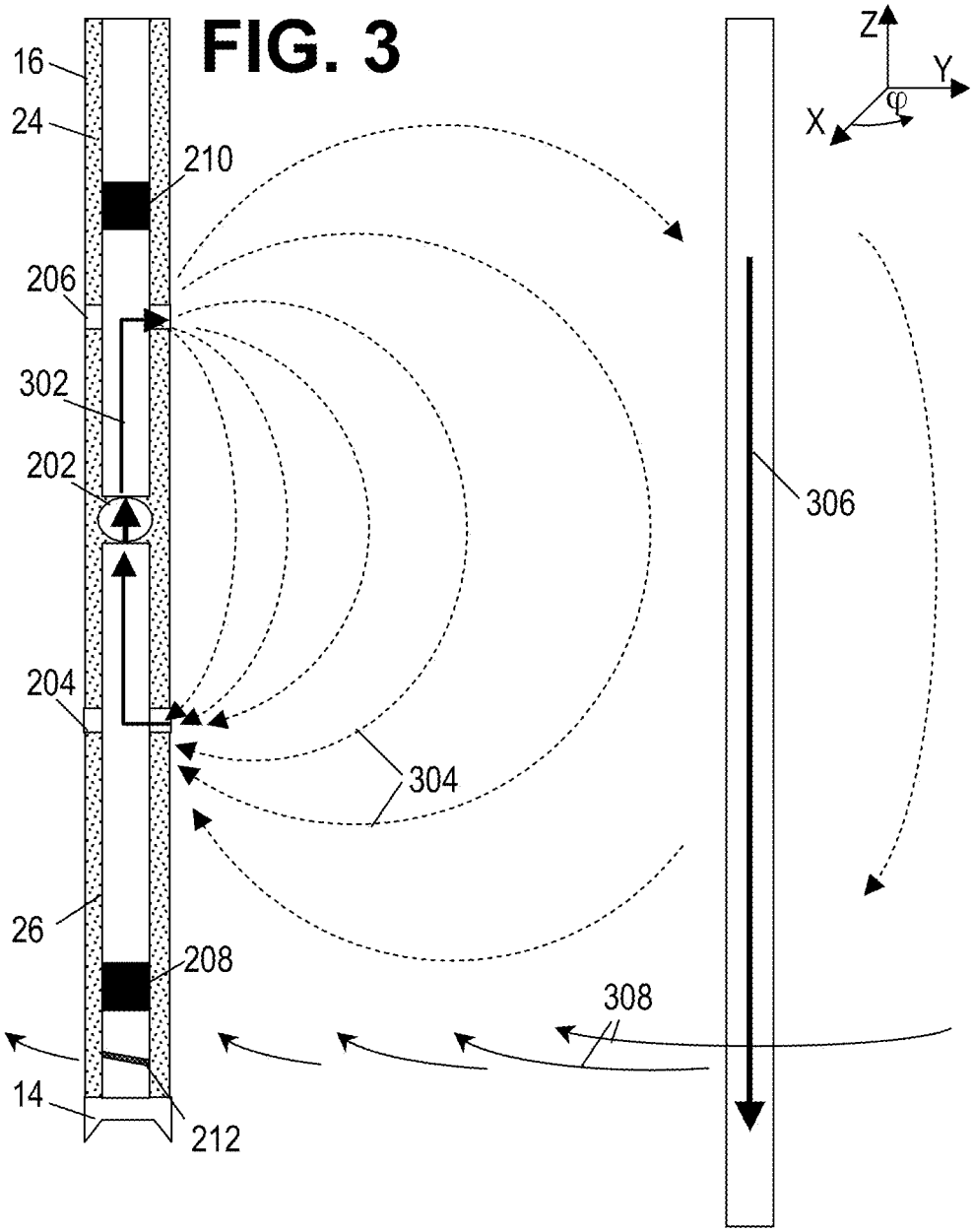
FIG. 3 illustrates the operating principles of the illustrative passive ranging system.

The principles of operation will now be described with reference to FIG. 3. Ranging tool 26 includes two bridges 204, 206 that establish a low impedance path between the current source 202 and the surrounding formation. The current source 202 injects a current 302 that disperses outwardly in the surrounding formation as generally indicated by dashed lines 304. Where such formation currents encounter a conductive object such as a low resistivity formation or a well casing 305, they will preferentially follow the low resistance path as a secondary current 306.

The secondary current 306 generates a magnetic field 308 that should be detectable quite some distance away. At least one receiver antenna coil 212 is mounted on the ranging tool 26 to detect this field. In FIG. 3, the magnetic field that reaches the ranging tool will be mostly in the x-direction, so the receiver antenna should have at least some sensitivity to transverse fields. The illustrated antenna coil 212 is tilted at about 45° to make it sensitive to transverse fields as the drill string rotates. That is, the secondary current induces magnetic field lines perpendicular to the current flow, and a receiver coil antenna having a normal vector component along the magnetic field lines will readily detect the secondary current flow.

Because the magnetic field produced by the primary current 302 on the mandrel is symmetrical around z-axis (in FIG. 3) and polarized in ϕ-direction, and the magnetic field generated by the secondary current 306 is polarized in x-direction at the receiver antenna 212, direct coupling from the source can be readily eliminated (and the signal from the conductive casing or boundary enhanced) by properly configuring and orienting the receiver antenna. If more than one receiver antenna is employed, elimination of the direct coupling is readily accomplishable by, e.g., a weighted sum of the received signals.

Figure 4:
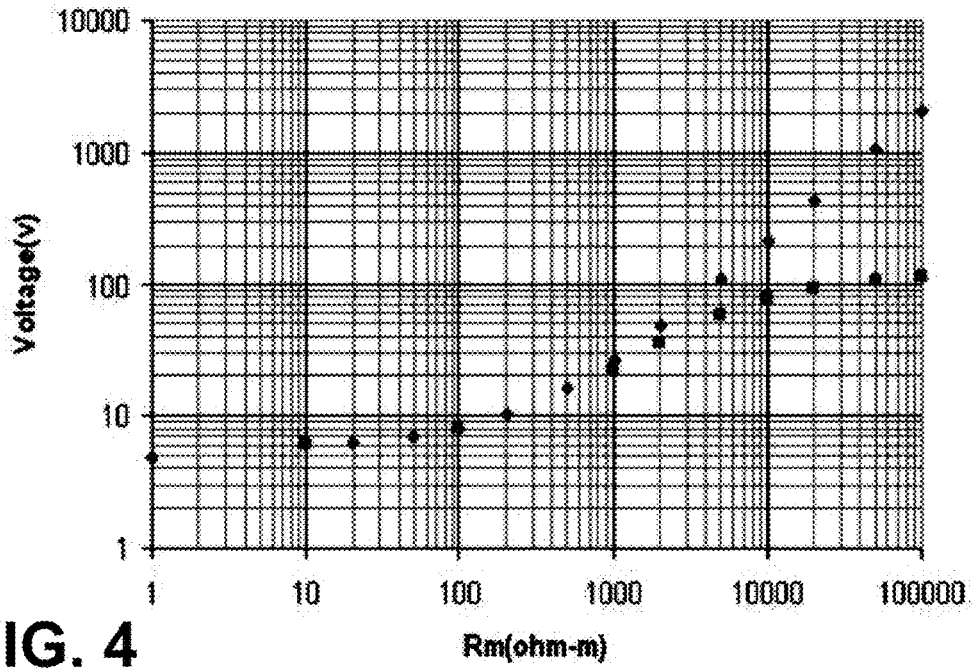
FIG. 4 is an illustrative graph of transmitter voltage as a function of fluid resistivity.

To verify that the above-described operating principles will function as expected, the operation of the ranging tool 26 has been modeled. FIG. 4 shows the voltage required to drive a given current into a given formation from a tool in a fluid-filled borehole as a function of the fluid's resistivity. The diamond-shaped points represent the performance of a tool without a bridge, whereas the square points represent the performance of a tool with conductive bridges 204, 206. Without the bridge, the voltage rises almost linearly with the resistivity of the borehole fluid, whereas the bridge mitigates the influence of the borehole fluid.

Figure 5:
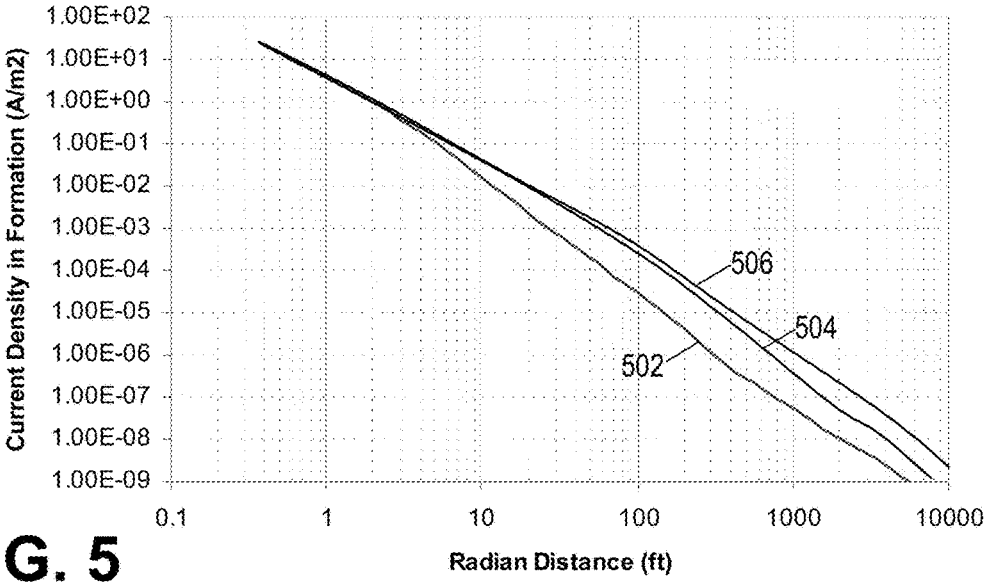
FIG. 5 is an illustrative graph of current density as a function of radial distance.

FIG. 5 compares the simulated current density vs radial distance from the borehole as a function of bridge spacing. Curve 502 represents the current density for L=1 (i.e., a bridge-to-bridge spacing of 2 ft). Curves 504 and 506 represent L=45 and L=60, respectively. Secondary currents should be detectable for conductors 20 ft away (for L=1) to over 100 ft (for L=60). In comparison to the existing tools, this passive ranging tool design is able to detect much deeper in the formation for a given drive voltage.

FIG. 6 is a graph that shows the expected azimuthal dependence of the receive signal voltages induced in the tilted coil antenna 212 as the mandrel tool rotates from 0 to 180 degrees. The two curves show a sinusoidal-like dependence on the rotation angle of receiving antennas at different distances from the source 202. The sinusoidal dependence enables the direction to the casing to be determined. The receive signal amplitudes will vary as a function of the casing distance. The smaller the distance, the larger the signal strength. This characteristic offers a way to determine casing distance.

Figure 7:
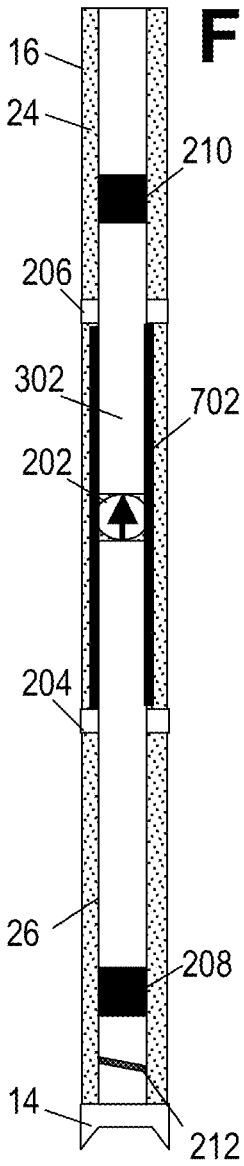
FIGS. 7-8 show alternative tool configurations.
Figure 8:
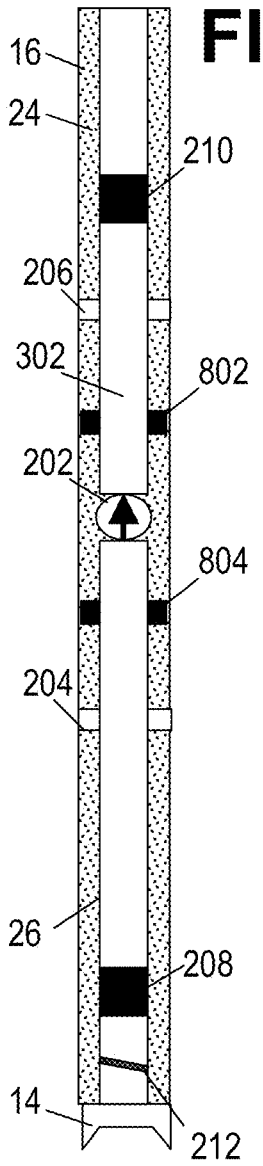

If the conductive bridges 204, 206 are positioned sufficiently far from the source 202, there is a risk that the drillstring between the bridges will intermittently contact the borehole wall. Such intermittent contact might be expected to cause unexpected changes to the positions of the current injection points, which in turn would affect the current distribution in the formation and the strength of secondary currents. Some contemplated tool embodiments prevent such contact with an insulative coating 702 over that portion of the drillstring between the bridges as shown in FIG. 7, though it may not be necessary to coat the entire surface between the bridges. For example, it may prove sufficient to coat just the center half of the region between the bridges, or just the region between the source and one of the bridges. Alternatively, insulated centralizers 802, 804 may be positioned on the drillstring at regular intervals between the bridges as shown in FIG. 8. Both configurations should eliminate any unexpected shifting of current injection points if this should prove to be a problem.

The tool can include multiple receiver antennas or magnetic sensors to provide enhanced signal detection. The sensors or antennas are preferably oriented parallel or perpendicular to each other for easy signal processing, but different tilt angles, azimuthal relationships, and spacings are also contemplated for the receiver antennas. However, where the coils are not parallel or perpendicular to each other, it is expected that some additional processing would be required to extract the desired magnetic field measurements. The use of multi-component field sensing would enable the detection of formation properties at the same time as detection and tracking of conductive features is being carried out.

FIG. 9 is a flow diagram of an illustrative ranging method for use in a borehole having oil-based drilling fluid. Beginning in block 902, a logging while drilling tool excites a current flow between axially-spaced bridges on the drill string in the borehole. As previously explained, the current disperses from the bridges into the formation and, upon encountering a conductive feature such as a well casing or other pipe, causes a secondary current to flow. In block 904 the tool makes azimuthal magnetic field measurements with one or more receiver antennas. The receiver antennas may be rotating with the tool as these measurements are acquired, but this is not a requirement.

In block 906, the received signals are analyzed for evidence of a secondary current. To detect the magnetic field of a secondary current, it is desirable to filter out other fields such as, e.g., the earth's magnetic field, which can be readily accomplished by ensuring that the frequency of the primary current is not equal to zero (DC). Suitable frequencies range from about 1 Hz to about 500 kHz. A rotational position sensor should also be employed to extract signals that demonstrate the expected azimuthal dependence of FIG. 6. If a secondary current signal is detected, then in block 908 the tool or a surface processing system analyzes the signals to extract direction and distance information. A forward model for the tool response can be used as part of an iterative inversion process to find the direction, distance, and formation parameters that provide a match for the received signals.

It is expected that the disclosed tool design will eliminate direct coupling from the transmitter, thereby improving measurement signal to noise ratio and making the secondary current signal readily separable from signals produced by the surrounding formation. As a consequence, it is expected that even distant well casings (greater than 100 ft away) will be detectable.

Various alternative embodiments exist for exploiting the disclosed techniques. Some drillstrings may employ sets of bridges and multiple toroids to produce primary currents from multiple points on the drillstring. These primary currents may be distinguishable through the use of time, frequency, or code multiplexing techniques. Such configurations may make it easier to discern the geometry or path of the remote well.

It is expected that the system range and performance can be extended with the use of multiple receiver stations and/or multiple transmit stations. In many situations, it may not be necessary to perform explicit distance and direction calculations. For example, the measured magnetic field values may be converted to pixel colors or intensities and displayed as a function of borehole azimuth and distance along the borehole axis. Assuming the reference borehole is within detection range, the reference borehole will appear as a bright (or, if preferred, a dark) band in the image. The color or brightness of the band indicates the distance to the reference borehole, and the position of the band indicates the direction to the reference borehole. Thus, by viewing such an image, a driller can determine in a very intuitive manner whether the new borehole is drifting from the desired course and he or she can quickly initiate corrective action. For example, if the band becomes dimmer, the driller can steer towards the reference borehole. Conversely, if the band increases in brightness, the driller can steer away from the reference borehole. If the band deviates from its desired position directly above or below the existing borehole, the driller can steer laterally to re-establish the desired directional relationship between the boreholes.

Numerous other variations and modifications will become apparent to those skilled in the art once the above disclosure is fully appreciated. It is intended that the following claims be interpreted to embrace all such variations and modifications.

What is claimed is:

1. A method for detecting a conductive feature from a borehole filled with an oil-based fluid, the method comprising:

providing current flow between two axially-spaced conductive bridges on a conductive tubular in the borehole, said current flow dispersing into a surrounding formation and causing a secondary current flow in the conductive feature;

detecting a magnetic field from the secondary current flow with at least one azimuthally-sensitive antenna in the borehole; and obtaining magnetic field measurements at multiple azimuths from the borehole and, based at least in part on said measurements, determining a direction of the conductive feature from the borehole.

2. The method of claim 1, wherein the bridges comprise stabilizer fins having an outer diameter substantially equal to a nominal diameter of the borehole.

3. The method of claim 1, wherein the bridges comprise centralizer springs or other compliant conductors that maintain contact with a wall of the borehole.

4. The method of claim 1, wherein said obtaining includes making said measurements with antennas having different azimuthal sensitivities.

5. The method of claim 1, wherein said obtaining includes rotating said at least one antenna to make said measurements.

6. The method of claim 1, further comprising adjusting a drilling direction based at least in part on said direction.

7. The method of claim 1, further comprising estimating a distance to the conductive feature from the borehole.

8. The method of claim 1, wherein said current flow is an alternating current.

9. The method of claim 1, wherein said providing includes imposing a voltage across an insulated gap in the conductive tubular.

10. The method of claim 1, wherein said providing includes employing a toroid around the conductive tubular to induce the current flow.

11. The method of claim 1, wherein the conductive feature is an existing well.

12. A system for detecting a conductive feature from a borehole filled with an oil-based fluid, the system comprising:

a tool that induces a current flow between two axially-spaced conductive bridges on a conductive tubular in the borehole so as to cause a secondary current flow in the conductive feature; and at least one azimuthally-sensitive antenna that detects a magnetic field from the secondary current flow, wherein the tool obtains magnetic field measurements at multiple azimuths from the borehole, and wherein the system further comprises a processor that determines a direction of the conductive feature from the borehole based at least in part on said measurements.

13. The system of claim 12, wherein the bridges comprise stabilizer fins having an outer diameter substantially equal to a nominal diameter of the borehole.

14. The system of claim 12, wherein the bridges comprise centralizer springs or other compliant conductors that maintain contact with a wall of the borehole.

15. The system of claim 12, wherein tool obtains said measurements with antennas having different azimuthal sensitivities.

16. The system of claim 12, wherein said at least one antenna rotates to make said measurements.

17. The system of claim 12, further comprising a steering mechanism that adjusts a drilling direction based at least in part on said direction.

18. The system of claim 12, wherein the processor further determines a distance to the conductive feature from the borehole.

19. The system of claim 12, wherein said current flow is an alternating current.

20. The system of claim 12, wherein the tool includes a power source that imposes a voltage across an insulated gap in the tool body.

21. The system of claim 12, wherein the tool includes a toroid around the conductive tubular to induce the current flow.

22. The system of claim 12, wherein the conductive feature is an existing well.

* * * * *